US007413773B2

(12) United States Patent
McCoy et al.

(10) Patent No.: US 7,413,773 B2
(45) Date of Patent: Aug. 19, 2008

(54) INTERNALLY COLORED BLOCK AND PROCESS

(76) Inventors: John McCoy, 2822 Main St., Riverside, CA (US) 92501; Deborah Elliott, 2822 Main St., Riverside, CA (US) 92501

( * ) Notice: Subject to any disclaimer, the term of this patent is extended or adjusted under 35 U.S.C. 154(b) by 737 days.

(21) Appl. No.: 10/500,442

(22) PCT Filed: Jul. 31, 2003

(86) PCT No.: PCT/US03/23925

§ 371 (c)(1),
(2), (4) Date: Jun. 29, 2004

(87) PCT Pub. No.: WO2005/017273

PCT Pub. Date: Feb. 24, 2005

(65) Prior Publication Data

US 2005/0066603 A1 Mar. 31, 2005

(51) Int. Cl.
*B05D 7/22* (2006.01)

(52) U.S. Cl. ..... 427/231; 52/306; 427/232; 427/235; 427/240; 427/181; 427/183; 65/395

(58) Field of Classification Search ..... 52/306; 65/395; 427/231, 232, 235, 240, 181, 183

See application file for complete search history.

(56) References Cited

U.S. PATENT DOCUMENTS

| | | | | | |
|---|---|---|---|---|---|
| 2,697,025 | A * | 12/1954 | Fulton et al. | 423/337 |
| 3,323,489 | A * | 6/1967 | Gustin | 118/622 |
| 3,859,119 | A * | 1/1975 | Fletcher et al. | 220/2.1 R |
| 4,289,089 | A * | 9/1981 | Tacke et al. | 118/306 |
| 4,887,404 | A * | 12/1989 | Saji et al. | 52/306 |
| 4,941,302 | A * | 7/1990 | Barry | 52/171.3 |
| 4,969,282 | A * | 11/1990 | Eberhart | 40/545 |
| 5,006,967 | A * | 4/1991 | Diamond | 362/147 |
| 5,333,427 | A * | 8/1994 | Uhlik | 52/306 |
| 5,707,691 | A * | 1/1998 | Plester et al. | 427/472 |
| 5,716,672 | A * | 2/1998 | Toyoda et al. | 427/235 |
| 6,260,317 | B1 * | 7/2001 | Fisher | 52/306 |
| 6,773,748 | B2 * | 8/2004 | Slat et al. | 427/237 |
| 7,022,387 | B1 * | 4/2006 | Fertig | 428/34.4 |
| 2002/0122883 | A1 * | 9/2002 | Slat et al. | 427/237 |

* cited by examiner

*Primary Examiner*—Jeanette Chapman
*Assistant Examiner*—Daniel Kenny
(74) *Attorney, Agent, or Firm*—Paul H. Ware, Esq.; Vernon R. Yancy, Esq.

(57) ABSTRACT

Internally colored glass and glass-like blocks (10) and the method for making them. No means for coating the internal cavities (26) of clear glass and glass-like hollow blocks has been available. Color coating provides aesthetically pleasing structures. Internally colored glass and glass-like blocks may be used in building internal room dividers, providing colorful building designs and for providing color relief in heretofore otherwise drab structures.

7 Claims, 2 Drawing Sheets

INTERNALLY COLORED BLOCK AND PROCESS

TECHNICAL FIELD

This invention relates to internally colored glass-like and glass blocks and the process employed by the methods of the invention to create that internal coloring while retaining the inherent outer sheen and finish of the original glass-like block workpiece. In the process employed by the invention, the structural integrity of the blocks is preserved. The term "glass-like" is defined to include glass and other materials which may have light transmissive qualities.

BACKGROUND ART

The relevant prior art includes U.S. Pat. No. 595,485, to Charles R. Lamb for *Mosaic Tile* issued Dec. 14, 1897. The article of manufacture described in the Lamb patent represents an early attempt to provide a decorative glass structure adapted for mosaic work. The structure as described by Lamb may comprise two transparent glass plates having interposed therebetween a layer of metallic foil and being subsequently bonded by heat treatment so as to be practically inseparable. The inventor herein suggests that an ordinary glazier's diamond can be employed to subdivide the structure so formed into shapes and sizes as desired by the user thereof.

Another prior art U.S. Pat. No. 2,086,185, was issued to Joseph C. Keaney and dated Jul. 6, 1937, for *Building Block.* A stated primary object of the patent to Keaney is to provide a hollow glass building block adapted to be formed in automatic glass blowing machinery. The inventor noted the practice of the day to form a structural glass building block by the method of molding two semicubical shells of glass and then bonding the shells together to form a complete block. Keaney's block is formed integrally in glass blowing machinery.

Additionally, U.S. Pat. No. 2,167,764 was patented on Aug. 1, 1939 for *Glass Building Block* for inventor William, O. Lytle. Lytle's patent describes a transparent sheet of synthetic resin situate between the usual opposing rectangular cup shapes making up a structural glass building block such that the resin provides increased structural strength, greater resistance to the passage of radiant heat and acts as a seal, strongly adherent to glass under heat and pressure, for the opposing edges of the half sections of the block. The inventor further suggests that the resin sheet may be colored so as to cut out part of the light or for decorative purposes in which case it may be printed with designs.

Yet another prior art U.S. Pat. No. 2,261,011 was issued on Oct. 28, 1941 to Otis W. Wiley for *Building Block.* The patent to Wiley relates primarily to the manufacture of hollow glass building blocks having a fusible screen disposed between the edges of the members forming the block, the screen becoming a permanent part of the completed block upon being fused therebetween by heat treatment.

Of somewhat lesser relevance to the instant invention are the U.S. Pat. No. 3,954,326, issued May 4, 1976 to Michaelis for *Translucent Building Blocks* and U.S. Pat. No. 5,038,542 to inventor Kline on Aug. 13, 1991 for *Architectural Building Block Herewith.*

The patent to Michaelis describes a hollow, translucent building block partially filled with a transparent liquid and with an oblique wall inserted in such manner as to give rise to the visual effects sought by the invention through the optical phenomenon of total internal reflection.

The building block specified by Kline describes an injection molded plastic block structure featuring snap lock connectors to provide even spacing between blocks when assembling a structure made up of a plurality of such blocks. The plastic blocks are claimed to resemble common glass blocks and additionally to provide for tinting by the introduction of tinting materials into the molding resin either prior to or during the molding process. Kline describes various decorative implementations in connection with this patented invention.

A final prior art patent discovered in applicant's pre-examination novelty search is U.S. Pat. No. 5,160,566, granted to Ashby et al. on Nov. 3, 1992 for *Decorative Glass Block.* Ashby et al. describe a scheme by means of which a decorative panel insert may be interposed between the two adjoined half members through a slot cut into and extending from the top of one vertical side wall of the glass block to the opposite vertical side wall. Subsequent to insertion, the panel is cemented to the bottom interior surface of the of the glass block and the slot is sealed over.

These prior art articles and their methods are commendable and show a creative spirit for their times. The quest for relieving the monotony of clear glass blocks has been long and varied and many creative ideas have been contrived. The originators and their methods have contributed remarkably to the technology involved. These prior art structures, however, do not include those elements of the instant invention that provide a long felt but unmet need in the art.

DISCLOSURE OF INVENTION

In accordance with the instant invention, there is provided a method for internally coloring heretofore clear, hollow structural glass-like blocks. Vibrant and exciting colors may be attained over a variety of tints and shades through implementation of the process presented. Structural designs using the colored glass-like building blocks provided by means of the benefits presented by the instant method are limited only by the imagination and creativity of the user.

BRIEF DESCRIPTION OF DRAWINGS

Further advantages and features of the instant invention will be more fully apparent to those skilled in the art to which the invention pertains from the ensuing detailed description thereof regarded in conjunction with the accompanying drawings wherein like reference numerals refer to like parts throughout and in which.

BEST MODE FOR CARRYING OUT THE INVENTION

Figure 1:
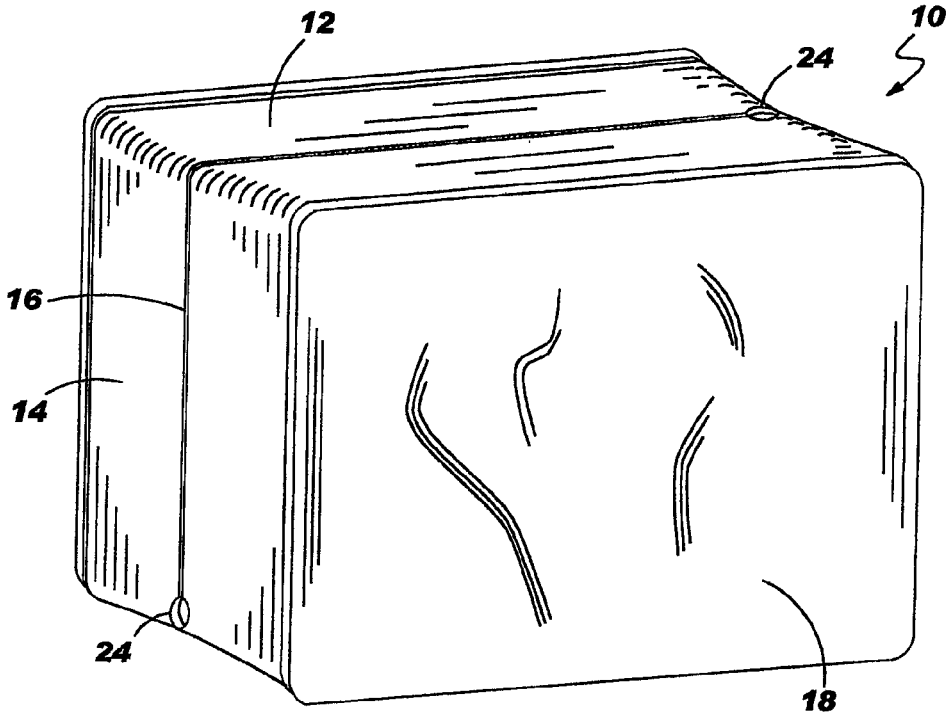
FIG. 1 is a perspective view of a conventional hollow glass-like building block as contemplated by the method of the instant invention.

Referring to the drawing and to FIG. 1 with greater particularity the hollow glass-like building block is denoted generally by the numeral 10 and comprises a top side wall 12 and a lateral side wall 14. A peripheral sealing seam 16 operates to adjoin the two halves of the building block. Holes 24 are drilled in diametrically opposed corner side wall portions of the hollow block, the purpose for which will be made clear in what follows.

Figure 2:
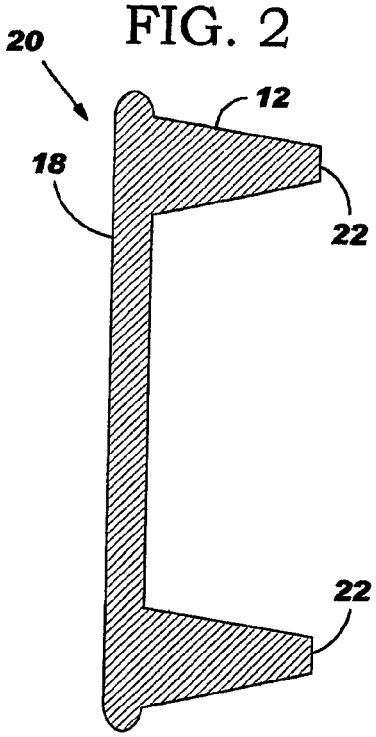
FIG. 2 is a vertical cross section of one of the half members forming one side of a conventional hollow glass-like building block as contemplated by the instant invention.
Figure 3:
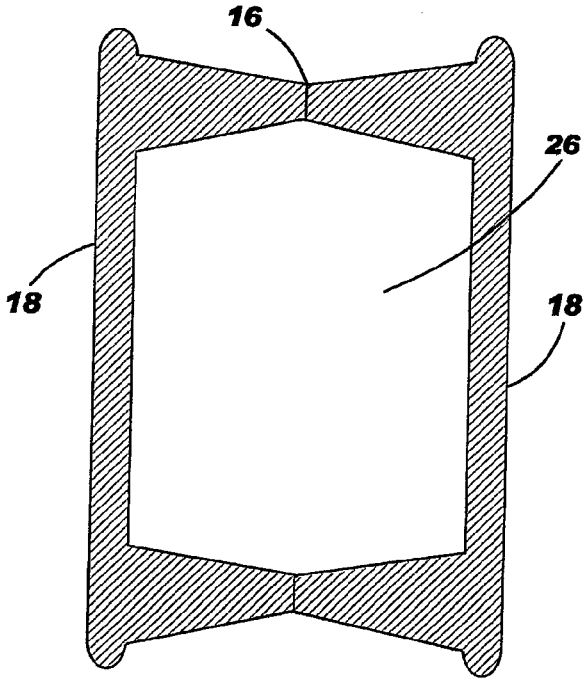
FIG. 3 is a vertical cross section of a conventional hollow glass-like building block showing the joining of the two half members to form the block.

Referring now to FIGS. 2 and 3 the numeral 18 denotes the outer face panels of the hollow block, that is, the part of the block that is most often presented to view while numeral 20 denotes a half member generally. Edges 22 of two half members 20 are joined together to form the block as shown in cross section in FIG. 3, thus creating the internal sealed chamber or interior cavity 26. The internal sealed chamber 26 is a hollow, light transmissive cavity which may be translucent and is the element of the hollow glass-like block 10 into which a coloring agent is introduced to form an internal, permanently bonded coating in accordance with the invention through holes 24, wherein one of holes 24 is used for the introduction of a coloring agent material 32 and its diametrically opposed hole 24 allowing air to enter for convenient egress of that material.

Figure 4:
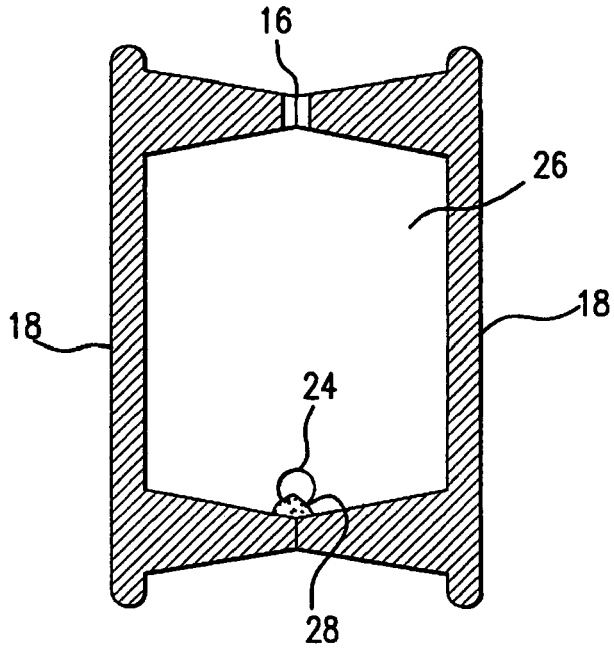
FIG. 4 is a vertical cross section of a conventional hollow glass-like building block showing the residue attendant to the drilling of the block.
Figure 5:
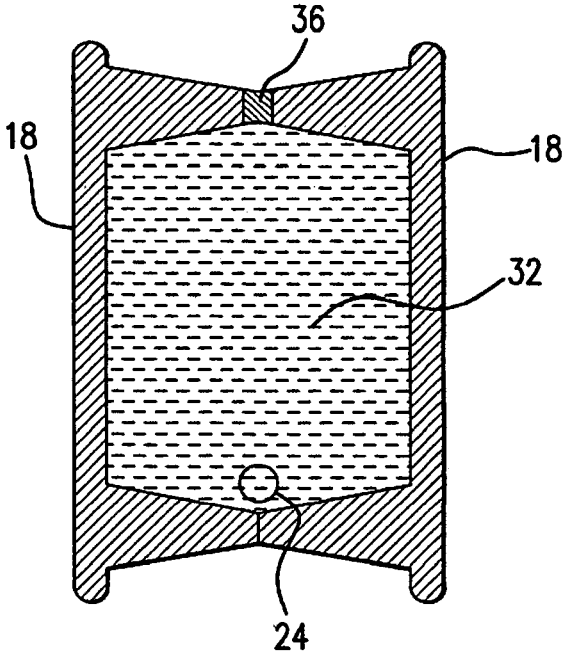
FIG. 5 is a vertical cross section of a conventional hollow glass-like building block showing the coloring agent material introduced into the block.
Figure 6:
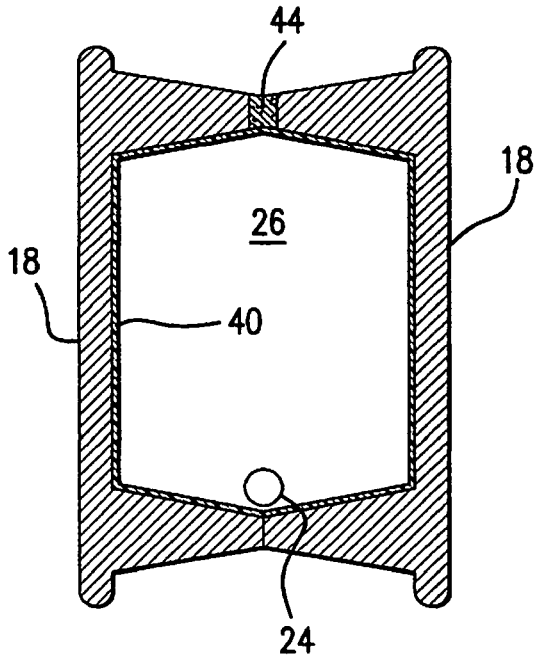
FIG. 6 is a vertical cross section of a conventional hollow glass-like building block showing the coloring agent material introduced into the block and forming an internal coating.

More explicitly and for the purpose of presenting a working example, in practicing the process specified herein, two holes 24 are drilled in diametrically opposed side wall corners of a conventional hollow glass block 10. With reference to FIG. 4, any residue 28 attendant to the drilling is removed from the interior chamber or interior cavity 26 of the block. This residue 28 has been removed by rinsing with water and then drying or allowing to dry. Into one of these holes 24 oriented at the top side wall of the block 10 is introduced a permanently bonding coloring agent material 32, preferably a liquid and preferably by pouring, FIG. 5. The holes 24 are temporarily sealed or plugged 36 so as to retain the permanently bonding coloring agent material 32 in the cavity 26. The block 10 is then rolled about or rotated so as to cover all sides of the interior chamber or cavity 26 with the coloring agent material 32 and then emptied of the coloring agent material, forming an internal coating 40 therein, FIG. 6. If both holes 24 are unsealed or unplugged the coloring agent material 32 is easily emptied or expelled from the cavity 26 through one of the holes 24. The block may be oriented so as to facilitate the draining of any excess coloring agent material 32. After a drying period, the holes 24 are permanently sealed 44 by filling with a silicone sealant or the like.

Further to the presentation of this working example, suitable coloring agent materials have been determined empirically. Examples of these materials as described below are not intended to be exclusive but merely indicative of coloring materials which have been found by experiment to be satisfactory in the practice of the method of the invention.

For light blue, green magenta, red, goldenrod, purple and orange. a mixture of eight (8) parts clear, two (2) parts catalyst and one (1) part colorant has been determined to work well. While for dark blue we have used eight (8) parts clear, two (2) parts catalyst and two (2) parts colorant. Of course, as is obvious, in order to obtain varying hues, somewhat more or somewhat less colorant may be utilized.

In order to form a permanently bonding, hard, thin coating, we blended the clearcoat with the colorant before adding the catalyst hardener.

The term "clear" denotes a generic acrylic urethane clearcoat obtainable under the tradename SUNFIRE® from SHERWIN-WILLIAMS AUTOMOTIVE FINISHES CORP.

The term "catalyst" as used herein refers to a generic hardening and drying agent well known in the automotive finishes art and obtainable under the tradename SUNFIRE CLEAR HARDENER® from SHERWIN-WILLIAMS AUTOMOTIVE FINISHES CORP.

The colorant materials used in our experiments in practicing the invention include the materials identified by specification numbers:

Number F6L1118 by SHERWIN WILLIAMS® for blues;

Number F6G1111 by SHERWIN WILLIAMS® for greens;

Number 3128 California Gold by SEM® for goldenrod;

Number 3118 Candy Apple Red by SEM® for red;

Number 3088 Mandarin by SEM® for orange;

Number 3018 Winefire by SEM® for magenta; and

Number 3108 Passion Purple by SEM® for purple.

SHERWIN-WILLIAMS® and SEM® are identified and located as:

Sherwin-Williams Automotive Finishes Corp. 101 Prospect Ave. N.W. Cleveland, Ohio 44115 United States of America SEM PRODUCTS, INC. 651 Michael Wylie Dr. Charlotte, N.C. 28217 United States of America It is to be emphasized that these described coloring materials and colorants are exemplary only and not intended as limitations on the methods of the invention.

INDUSTRIAL APPLICABILITY

The present invention finds application wherever glass-like building blocks are used in building construction or otherwise for decorative purposes and to relieve the tedium and monotony associated with colorless materials.

The invention claimed is:

1. A method for internally coloring a hollow glass-like block having an interior cavity comprising the steps of:

drilling at least one hole in at least one corner side wall of said block;

removing any residue caused by said drilling from said interior cavity of said block;

introducing a coloring agent material into said interior cavity of said block through said at least one hole;

temporarily sealing said at least one hole so as to retain said coloring agent material within said interior cavity;

rotating said block in such manner as to coat its entire interior cavity with said coloring agent material;

removing said temporary sealing so as to expel any excess coloring agent material from said interior cavity;

expelling said excess coloring agent material from said cavity so as to leave a permanent interior coating therein;

allowing said coating material to dry;

permanently sealing said at least one hole.

2. The method of claim 1 wherein said drilling at least one hole is accomplished by the step of drilling one hole each in diametrically opposite corner side walls of said block.

3. The method of claim 2 wherein said removing any residue caused by said drilling from said interior cavity of said block is accomplished by the steps of:

rinsing with a liquid; and drying.

4. The method of claim 1 wherein the step of expelling said excess coloring agent material from said cavity so as to leave a permanent interior coating therein is accomplished by the step of draining.

5. The method of claim 1 wherein the step of permanently sealing said at least one hole is accomplished by the step of filling said at least one hole with silicone.

6. The method of claim 2 wherein the step of permanently sealing said at least one hole is accomplished by sealing said one hole each in diametrically opposite corner side walls of said block.

7. The method of claim 6 wherein the step of sealing said one hole each in diametrically opposite corner side walls of said block is accomplished by filling said one hole each with silicone.

* * * * *